US005655606A

United States Patent [19]

Ferguson

[11] Patent Number: 5,655,606

[45] Date of Patent: Aug. 12, 1997

[54] RUNNING TOOL FOR INSTALLING A WELLHEAD LOAD SHOULDER

[75] Inventor: Bobby L. Ferguson, Friendswood, Tex.

[73] Assignee: ABB Vetco Gray Inc., Houston, Tex.

[21] Appl. No.: 593,777

[22] Filed: Jan. 29, 1996

[51] Int. Cl.[6] ..... E21B 33/04; E21B 43/10

[52] U.S. Cl. ..... 166/382; 166/75.14; 166/85.1; 285/123.5

[58] Field of Search ..... 166/379, 382, 166/85.1, 85.3, 75.14, 208; 285/141, 142, 143, 144

[56] References Cited

U.S. PATENT DOCUMENTS

| | | | |
|---|---|---|---|
| 3,405,763 | 10/1968 | Pitts et al. | 166/382 |
| 3,661,206 | 5/1972 | Putch et al. | 166/208 X |
| 4,408,783 | 10/1983 | Gruller | 285/142 X |
| 4,416,472 | 11/1983 | Fowler et al. | 285/142 X |
| 4,691,780 | 9/1987 | Galle, Jr. et al. | 166/208 X |
| 4,886,121 | 12/1989 | Demny et al. . | |
| 4,919,460 | 4/1990 | Milberger et al. . | |
| 5,044,432 | 9/1991 | Cunningham et al. | 166/206 X |
| 5,184,686 | 2/1993 | Gonzalez . | |
| 5,209,521 | 5/1993 | Osborne . | |
| 5,255,746 | 10/1993 | Bridges | 166/382 X |
| 5,327,972 | 7/1994 | Theiss et al. . | |

*Primary Examiner*—George A. Suchfield
*Attorney, Agent, or Firm*—James E. Bradley

[57] ABSTRACT

A running tool is used to install a shoulder ring within a groove located in a wellhead housing after the wellhead housing has been installed. The running tool has a locator member which lands on a locator shoulder. A carrier collet which carries the shoulder ring. A retainer sleeve retracts the shoulder ring during the running in procedure. After the locator member lands on the locator shoulder, the operator strokes a piston. This moves the carrier collet and shoulder ring downward relative to the retainer sleeve, allowing the shoulder ring to expand out into the grooves. A cam surface forces the lower end of the collet to a contracted outer diameter, allowing retrieval of the running tool.

9 Claims, 3 Drawing Sheets

RUNNING TOOL FOR INSTALLING A WELLHEAD LOAD SHOULDER

BACKGROUND OF THE INVENTION

1. Field of the Invention

This invention relates in general to subsea wellheads, and in particular to a running tool for installing load shoulders in the wellhead.

2. Description of the Prior Art

When drilling a well for oil or gas, typically a wellhead housing will be mounted at the upper end of the well to a large diameter string of conductor pipe. The well is then drilled deeper and a string of casing will be run. Subsequently, the well will be drilled to a greater depth and at least one more string of casing will be installed.

A casing hanger is located at the upper end of each string of casing, the casing hanger landing on a load shoulder in the wellhead housing. In one type of wellhead housing, the shoulders are machined into the bore of the wellhead housing. In another type, the load shoulders are separate high strength rings that are installed into grooves in the wellhead housing while the wellhead housing is being manufactured. In both cases, the inner diameter of the wellhead housing bore will decrease in a downward direction, with the smallest inner diameter located below the lower shoulder.

The stepped diameter bore has a disadvantage. Drilling tools can be no larger than the minimum inner diameter located below the lower shoulder. Sometimes, it is desired to utilize a drill bit or tool that is larger than minimum inner diameter. U.S. Pat. No. 4,886,121 shows a load ring installed with a running tool after the wellhead housing is in place. In that patent, it is necessary to install a pin from the exterior of the wellhead. The pin extends through the wellhead housing below each groove for engagement by the load shoulder during the running process. The pin has to be screwed in to extend it from a full bore position to a position protruding into the bore. This presents a drawback for subsea wells, as it will require a diver or remote operated vehicle to rotate the pins from the subsea environment. Also, providing sealed threaded holes and threaded pins would be expensive.

SUMMARY OF THE INVENTION

In this invention, a running tool is employed to run a split, resilient shoulder ring. The running tool has a locator flange which lands on a shoulder provided in the bore above the grooves. This positions a lower end of the running tool next to one of the grooves. The running tool has a carrier member with an external flange which carries the shoulder ring. A retainer extends down over the carrier to hold the shoulder ring in a contracted position.

The running tool has a piston that when stroked moves the carrier member and retainer axially apart from each other, freeing the shoulder ring to expand out of its own resiliency into the groove. The carrier member is mounted to a mandrel which has an upper cam surface. As the piston moves toward the end of the retract stroke, the cam surface pivots the upper end of the carrier outward, causing the lower flange to contract to a retrieval diameter to clear the shoulder ring. This allows the operator to retrieve the running tool.

DETAILED DESCRIPTION OF THE INVENTION

Figure 1:
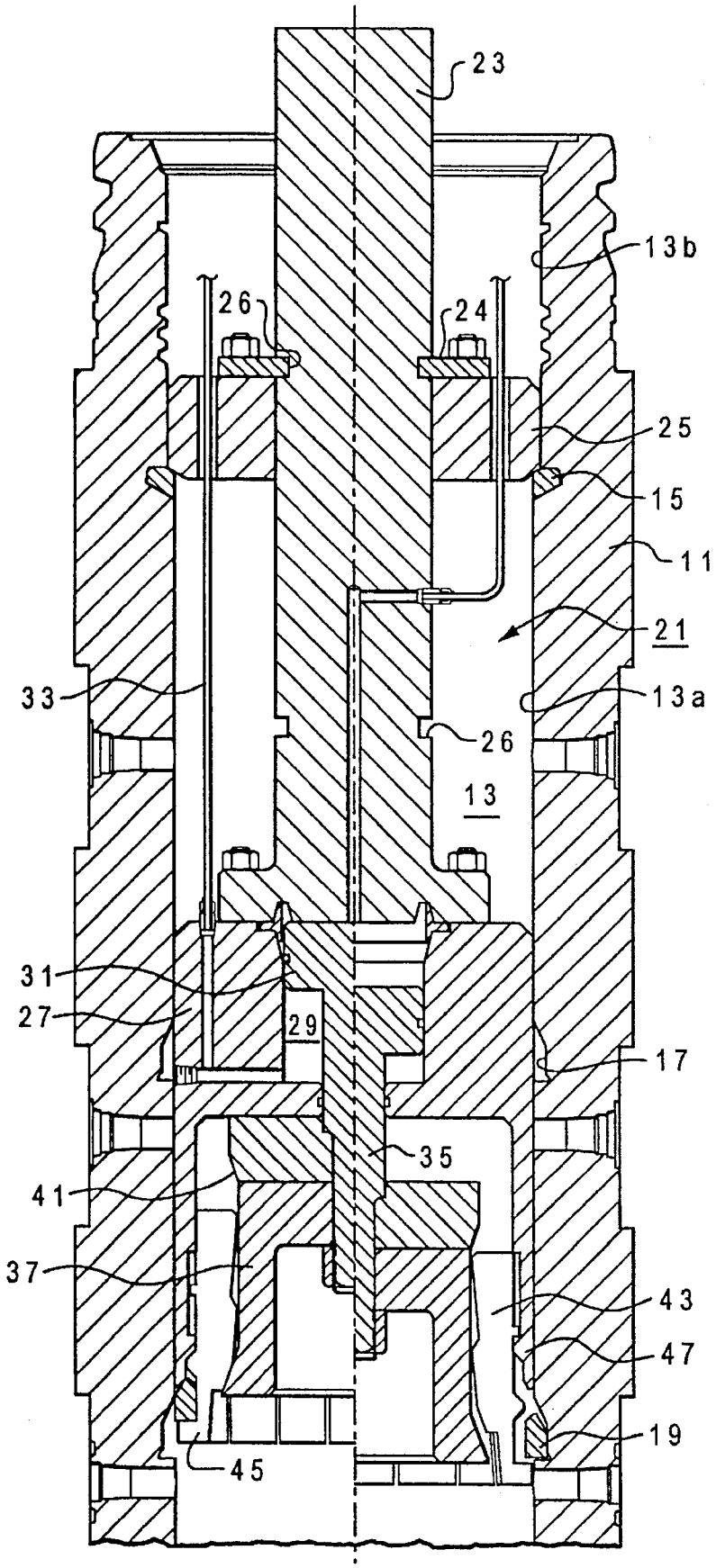
FIG. 1 is a vertical sectional view illustrating a running tool constructed in accordance with this invention, with the left side of the drawing showing a running-in position and the right side showing a release position.

Referring to FIG. 1, wellhead housing 11 is a tubular member located at the top of a well. The wellhead housing shown in the drawing is for use at the surface on a platform of an offshore well, but this invention is also applicable to a subsea wellhead housing located on the sea floor. Wellhead housing 11 has an axial bore 13 which has a constant inner diameter central portion 13*a* and an upper portion 13*b*, which is of a larger diameter and also constant in inner diameter. Upper portion 13*b* extends upward from a permanent locator shoulder 15 which is installed during manufacturing of wellhead housing 11.

Figure 3:
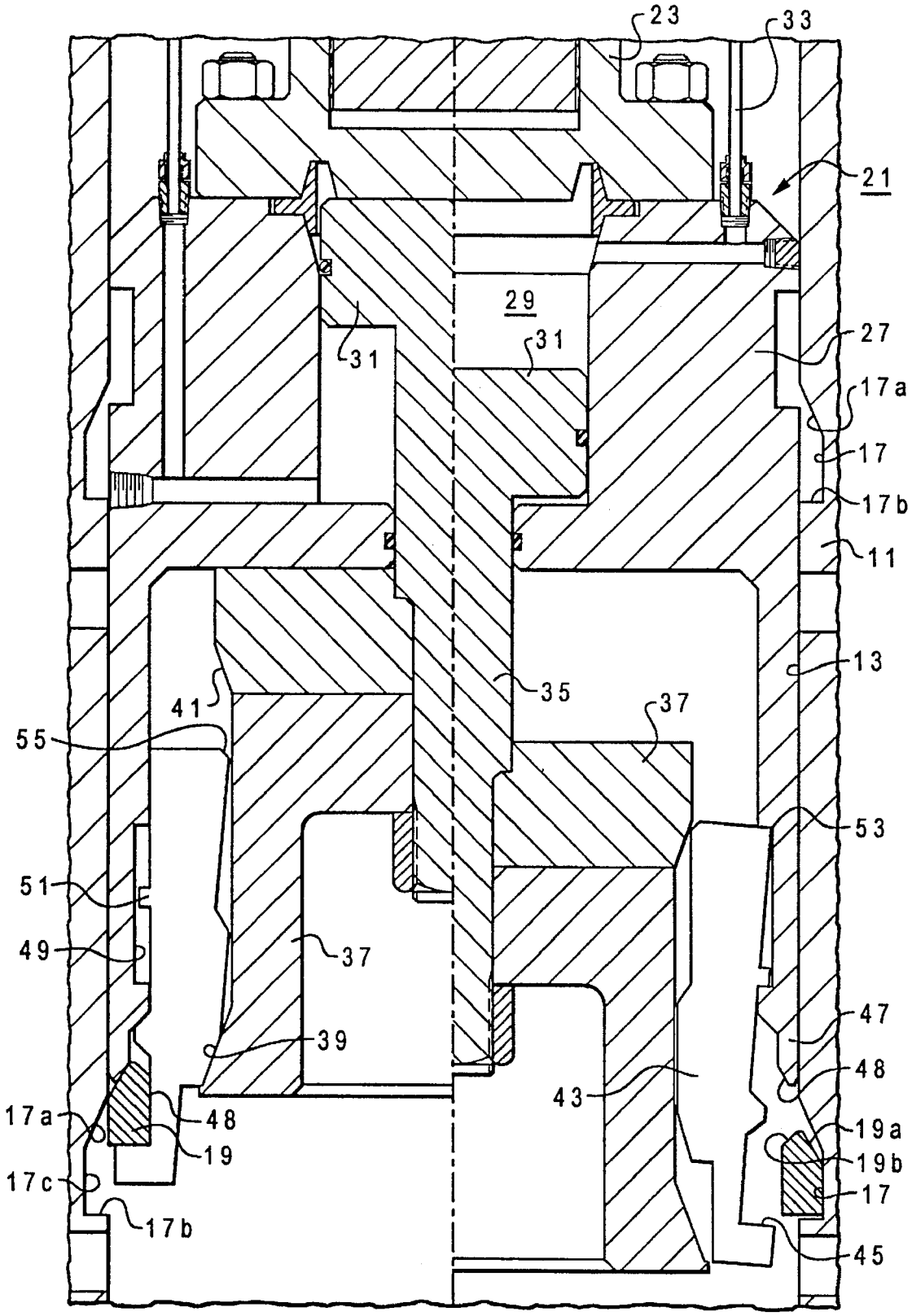
FIG. 3 is an enlarged sectional view of a portion of the running tool of FIG. 1, showing a running-in position on the left side and a retrieval position on the right side.

Two spaced apart circumferential grooves 17 are formed in the central bore portion 13*a*. As shown in FIG. 3, each groove 17 has an upper conical portion 17*a*, a flat base 17*b*, and a cylindrical outer wall 17*c* which joins upper conical portion 17*a* and base 17*b*. Base 17*b* is perpendicular to the axis of the bore 13. A shoulder ring 19 is adapted to locate within each of the grooves 17. Shoulder ring 19 is a resilient, metal, snap ring, having a split (not shown) and being radially contractible from a natural undeformed condition. Shoulder ring 19 has a lower edge that is flat for landing on groove base 17*b* and an outer diameter portion which is cylindrical for engaging the outer wall 17*c* of groove 17. An upper tapered portion 19*a* joins the cylindrical portion and inclines at the same angle as groove upper conical portion 17*a*. The inner diameter of shoulder ring 19 has a support shoulder 19*b* that is conical, inclining in an opposite direction to tapered portion 19*a*.

In the natural condition, the outer diameter of shoulder ring 19 is slightly greater than the inner diameter of groove outer wall 17*c* so that it will frictionally engage outer wall 17*c*. Once installed in groove 17, as shown on the right side of FIG. 3, the installed inner diameter of shoulder ring 19 will be less than the inner diameter of bore 13, resulting in support portion 19*b* protruding into bore 13. A portion of the lower edge of shoulder ring 19 will also protrude into bore 13 after installation. Shoulder ring 19 may be contracted to a running-in position, as shown on the left side of FIG. 3. In the running-in position, the running-in outer diameter of shoulder ring 19 is slightly less than the inner diameter of bore central portion 13*a*.

Referring again to FIG. 1, a running tool 21 is employed to install one of the shoulder rings 19 in each of the grooves 17. Running tool 21 will be lowered from a drilling rig, normally through a blow-out preventer (not shown) into bore 13. Running tool 21 has a shank 23 which secures to the lower end of the string of drill pipe. A locator member or ring 25 mounts to shank 23 by means of a retainer plate 24. Retainer plate 24 is bolted to locator ring 25 and engages a groove 26 in shank 23. There is also a lower groove 26 for engagement by retainer plate 24 to reposition locator ring 25 on running tool 21. Locator ring 25 has an outer diameter greater than the inner diameter of bore central portion 13*a* but less than the inner diameter of bore upper portion 13*b*.

Running tool 21 has a body 27 that is secured to shank 23. Body 27 is a tubular member having a cavity or cylinder 29 located within it. A piston 31 is carried in cylinder 29 for movement between an upper position, shown on the left side, to a lower position shown on the right side of FIG. 1. Hydraulic passages 33 extend to the upper and lower ends of cylinder 29 to stroke piston 31 between the upper and lower positions. Piston 31 has a shaft 35 that extends below body 27.

A mandrel 37, shown formed of two parts, is rigidly mounted to shaft 35 for movement therewith. Mandrel 37 is a tubular hollow member. It has a lower support surface 39 that tapers outward in a downward direction. It has an upper cam surface 41 that is shown formed on a separate part of mandrel 37 and which tapers outward in an upward direction.

A carrier member comprising a collet 43 is carried by mandrel 37. Carrier collet 43 is a cylindrical member having slits extending upward from its lower edge to its upper edge, forming several individual sections. The slits allow carrier collet 43 to radially contract and expand. Expanding the upper end of collet 43 causes the lower end to contract. Carrier collet 43 has a lower external flange 45 which protrudes radially outward for supporting shoulder ring 19.

A retainer sleeve 47 is integrally formed with body 27 and depends downward, extending around carrier collet 43. As shown in FIG. 3, retainer sleeve 47 has a lower end 48 that is tapered to mate with support portion 19*a* of shoulder ring 19. When in the running-in position, shown on left side of FIG. 3, lower end 48 of retainer sleeve 47 will hold shoulder ring 19 in a contracted or collapsed position. In the running-in position, the split of shoulder ring 19 will be closed, and the outer diameter of shoulder ring 19 will be less than the inner diameter of bore 13.

Retainer sleeve 47 has an inner recess 49 that receives an external rib 51 located on collet 43. Rib 51 is positioned to be located within recess 49 when running tool 21 is carrying shoulder ring 19 in the running-in position as shown in the left side of FIG. 3. When carrier collet 43 moves downward relative to retainer sleeve 47 a selected distance, as shown on the right side of FIG. 3, rib 51 contacts the lower end of recess 49, preventing further downward movement of carrier collet 43. Rib 51 and recess 49 allow limited axial movement of mandrel 37 and carrier collet 43 in unison relative to retainer sleeve 47, and serve as a stop means to prevent further axial movement of carrier collet 43, but allow continued downward movement of mandrel 37.

Carrier collet 43 has an upper outer edge 53 that pivots into the upper end of recess 49 when running tool 21 moves to the released position shown on the right side of FIG. 3. Carrier collet 43 has an upper inner edge 55 that is engaged by cam surface 41 when running tool 21 moves from the running-in position shown on the left side of FIG. 3 to the retrieval position shown on the right side of FIG. 3. The pivotal movement of the upper outer edge 53 of carrier collet 43 is caused by the upper inner edge 55 sliding on cam surface 41. Cam surface 41 expands the upper end of collet 43, causing lower flange 45 to radially contract.

Figure 2:
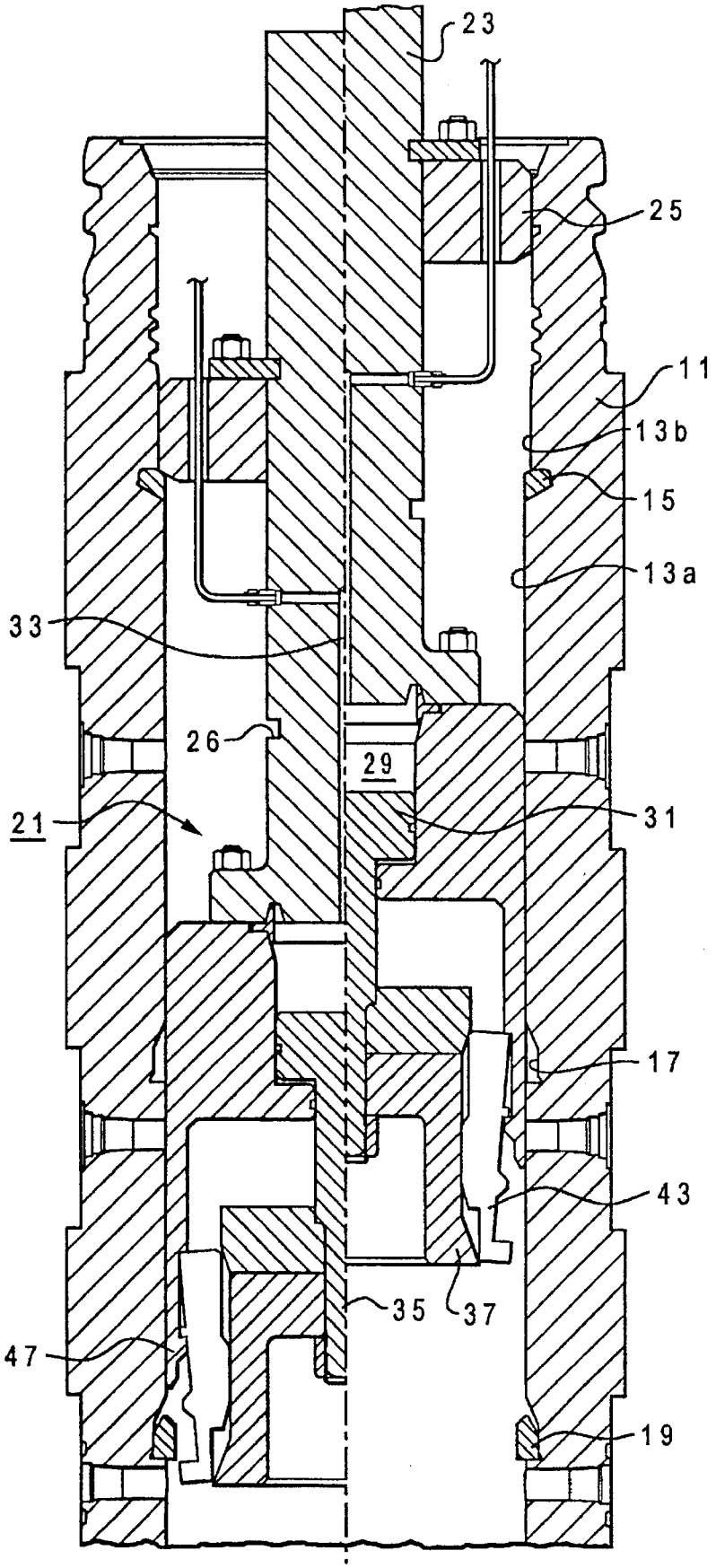
FIG. 2 is another sectional view of the running tool of FIG. 1, with left side showing a retrieval position and the right side showing the running tool being retrieved.

When in the retrieval position, shown on the right side of FIGS. 2 and 3, collet lower flange 45 will be contracted to a retrieval outer diameter less than the installed inner diameter of shoulder ring 19. This allows lower flange 45 to clear shoulder ring 19 when the tool is retrieved.

In operation, after installation of wellhead housing 11, the operator drills to a greater depth. Once that depth has been reached, the operator will install the shoulder ring 19 in lower groove 17. To install shoulder ring 19, the operator places shoulder ring 19 on flange 45 of carrier collet 43. The operator strokes piston 31 upward to retract mandrel 37 and carrier collet 43 within retainer sleeve 47. Lower end 48 of retainer sleeve 47 will hold shoulder ring 19 in the collapsed position shown on the left side of FIGS. 1 and 3. Mandrel lower support surface 39 will be in engagement with an inner portion of carrier collet 43, holding flange 45 in an expanded position. The operator secures locator ring 25 to the upper groove 26. The distance from locator ring 25 to shoulder ring 19 will be the same distance as from locator shoulder 15 to the lower groove 17. The operator secures shank 23 to a string of drill pipe (not shown) and lowers running tool 21 into wellhead housing 11, normally through a riser and blowout preventer.

Locator ring 25 will land on locator shoulder 15, positioning shoulder ring 19 next to groove 17. Preferably, at this point, the lower edge of shoulder ring 19 will be approximately midway between the groove base 17*b* and the upper edge of the groove conical portion 17*a*. The operator then applies hydraulic fluid pressure to one of the passages 33 to move piston 31 downward. The downward movement causes mandrel 37 and carrier collet 43 to move downward in unison with shoulder ring 19. Retainer sleeve 47, however, does not move downward. Once shoulder ring support portion 19*b* clears the lower end 48 of retainer sleeve 47, shoulder ring 19 will expand outward into its own resiliency, snapping into groove 17. This releasing of shoulder ring 19 occurs before piston 31 reaches the end of its stroke and is shown on the right side of FIG. 1.

Shortly after, the continued downward movement of collet carrier 43 will stop because of rib 51 contacting the lower end of recess 49. The upper inner edge 55 will be near the base of cam surface 41 and the upper outer edge 53 will be aligned with the upper edge of recess 49. Mandrel lower support surface 39 will be out of engagement with carrier collet 43. This releasing position is shown on the right side of FIG. 1.

Continued downward movement of piston 31 then causes the mandrel cam surface 41 to slide on carrier collet upper inner edge 55, pushing the upper end of carrier collet 43 radially outward. As shown on the right side of FIG. 3, cam surface 41 pivots the collet upper end 53 over into inner recess 49. This expansion of the upper end of carrier collet 43 contracts the outer diameter of lower flange 45 to the retrieval position shown on the right side of FIG. 3. In this retrieval position, piston 31 will be at the lower end of its stroke, and the outer diameter of lower flange 45 will be less than the installed inner diameter of shoulder ring 19. The operator then lifts running tool 21 as shown on the right side of FIG. 2.

After shoulder ring 19 is properly set in lower groove 17, the operator will lower a string of casing into the well. A conventional casing hanger (not shown) will land on support surface 19*b* of shoulder ring 19. The operator will cement the casing in place, then drill through the casing to even greater depth. The operator then will install another shoulder ring 19 in the upper groove 17 in the same manner as previously described. The second casing hanger will be installed on the shoulder ring 19 in the upper groove 17. To install the upper shoulder ring 19, the operator disconnects locator ring 25 from the upper groove 26 and reconnects it with plate 24 to the lower groove 26. This adjusts the axial distance between flange 45 and locator ring 25 to equal the distance from locator shoulder 15 to the upper groove 17. Eventually, the operator may use locator shoulder 15 to support a tubing hanger.

In the event the operator wishes to retrieve a shoulder ring 19 from groove 17 he will be able to utilize the same running tool 21. He will stroke piston 31 to the retrieval position shown on the right side of FIG. 3. He lowers running tool 21 until locator ring 25 lands on locator shoulder 15, placing flange 45 next to shoulder ring 19. The operator then strokes piston 31 to the upper position. Initially, mandrel 37 will move upward relative to carrier collet 43. After collet upper inner edge 55 moves off of cam surface 41, lower support surface 39 will expand flange 45 outward to the position shown on the right side of FIG. 1. The upper outer edge 53 will contract inward due to the resiliency of carrier collet 43, withdrawing from inner recess 49. Continued upward movement of piston 31 causes carrier collet 43 to begin upward movement also, with flange 45 engaging shoulder ring 19 and pulling it upward. As shoulder ring 19 rides up groove conical portion 17*a*, it will begin contracting and will be drawn up into engagement with retainer lower end 48. This is the position shown on the left side of FIG. 1. The operator then retrieves running tool 21, bringing along with it shoulder ring 19.

The invention has significant advantages, the running tool can selectively run and retrieve shoulder rings and grooves without needing any protruding structure below the groove. Access to the exterior of the wellhead housing to screw locating pins inward is not required. The running tool avoids the need for expensive threaded and sealed locator pins. This is particularly an advantage for subsea wellhead housings which preferably do not have any holes extending through the sidewalls.

While the invention has been shown in only one of its forms, it should be apparent to those skilled in the art that it is not so limited, but is susceptible to various changes without departing from the scope of the invention.

I claim:

1. A method for supporting a string of casing in a well, comprising:

providing a wellhead housing with a bore having a central portion which has an inner diameter and contains a circumferential groove;

providing a wellhead housing locator surface above the groove which has an inner diameter not less than the inner diameter of the central portion of the bore;

providing a split, resident, metal shoulder ring which has an uncontracted outer diameter greater than the inner diameter of the central portion of the bore;

providing a running tool with a running tool locator surface on the running tool which has an outer diameter greater than the inner diameter of the central portion of the bore;

mounting the wellhead housing at an upper end of the well; then placing the shoulder ring on the running tool at a point spaced below the running tool locator surface substantially the same distance as an axial distance from the wellhead housing locator surface to the groove, and contracting the shoulder ring to a running-in outer diameter less than the inner diameter of the central portion of the bore;

lowering the running tool into the wellhead housing, contacting the running tool locator surface with the wellhead housing locator surface to position the shoulder ring next to the groove; then releasing the shoulder ring from the running tool, allowing it to expand outward into the groove; then retrieving the running tool; then lowering the string of casing through the wellhead housing, securing a casing hanger to the upper end of the string of casing and landing the causing hanger on the shoulder ring.

2. The method according to claim 1 wherein the step of providing the wellhead housing locator surface comprises providing an annular locator shoulder in the bore at an upper end of the central portion of the bore.

3. The method according to claim 1 wherein the step of placing the shoulder ring on a running tool and contracting the shoulder ring to the running-in outer diameter comprises:

providing the running tool with a carrier member and placing the shoulder ring on the carrier member;

providing the running tool with a retainer member with the carrier member and retainer member being axially movable relative to other, and positioning the retainer member in engagement with the shoulder ring to hold the shoulder ring in the running-in outer diameter; and the step of releasing the shoulder ring comprises:

moving the carrier member and retainer member axially apart from each other to move the retainer member out of engagement with the shoulder ring.

4. The method according to claim 1 wherein the step of placing the shoulder ring on a running tool and contracting the shoulder ring to the running-in outer diameter comprises:

providing the running tool with a carrier member which has an external carrier flange and placing the shoulder ring on the carrier flange, the carrier flange having a running-in outer diameter that is greater than an installed inner diameter of the shoulder ring when the shoulder ring is installed in the groove;

providing the running tool with a retainer member wherein the carrier member and retainer member are axially movable relative to each other, and positioning the retainer member in engagement with the shoulder ring, retaining the shoulder ring in the running-in outer diameter; wherein the step of releasing the shoulder ring comprises:

moving the carrier member and retainer member axially apart from each other to move the retainer member out of engagement with the shoulder ring; and wherein the step of retrieving the running tool comprises:

contracting the carrier flange running-in outer diameter to a retrieval outer diameter that is less than the installed inner diameter of the shoulder ring, then withdrawing the running tool.

5. A method for installing a metal, resilient shoulder ring within a central portion of a bore of a wellhead housing which has a circumferential groove, comprising:

(a) providing the shoulder ring with an outer diameter while in an undeformed condition that is greater than an inner diameter of the central portion of the bore;

(b) providing a running tool with a carrier member and a retainer member which are axially movable relative to each other between a contracted position and an extended position;

(c) placing the shoulder ring on the carrier member and positioning the retainer member in engagement with the shoulder ring and in the contracted position relative to the carrier member to retain the shoulder ring in a contracted condition in which it has an outer diameter less than the inner diameter of the bore;

(d) lowering the running tool into the bore to a position where the shoulder ring is aligned with the groove; then (e) moving the carrier member and retainer member axially relative to each other to the extended position, disengaging the retainer member with the shoulder ring to release the shoulder ring, allowing it to expand outward into the groove; then (f) retrieving the running tool.

6. The method according to claim 5 wherein step (b) comprises:

providing the carrier member with an external carrier flange which has a running-in outer diameter when the carrier member is in the contracted position that is greater than an installed inner diameter of the shoulder ring when the shoulder ring is installed in the groove; wherein step (f) comprises:

contracting the carrier flange running-in outer diameter to a retrieval outer diameter that is less than the installed inner diameter of the shoulder ring, then withdrawing the running tool.

7. The method according to claim 5 wherein step (d) comprises:

providing a wellhead housing locator surface above the groove which has an inner diameter not less the inner diameter of the central portion of the bore;

providing a running tool locator surface on the running tool above the carrier flange which has an outer diameter greater than the inner diameter of the central portion of the bore; and landing the running tool locator surface on the wellhead housing locator surface.

8. The method according to claim 6, further comprising retrieving the shoulder ring from the groove after installation by the following steps:

lowering the running tool back into the bore and placing the carrier member flange below the shoulder ring in the groove with the carrier member in the extended position; then moving the carrier member and the retainer member axially relative to each other to the contracted position, causing the flange to engage the shoulder ring and pull it upward from the groove into engagement with the retainer member, which moves the shoulder ring to the contracted condition; then retrieving the running tool.

9. A method for retrieving a metal, split, shoulder ring from a circumferential groove in a central portion of a bore of a wellhead housing, the shoulder ring having an installed inner diameter while installed in the groove which is greater than an inner diameter of the central portion of the bore and a contracted outer diameter when in a contracted condition removed from the groove which is less than the inner diameter of the central portion of the bore, the method comprising:

providing a retrieval tool with a carrier member and a retainer member which are axially movable relative to each other between a contracted position and an extended position;

providing the carrier member with an external carrier flange which has an outer diameter when the carrier member is in the contracted position that is greater than the installed inner diameter of the shoulder ring, and an outer diameter when the carrier member is in the extended position that is less than the installed inner diameter of the shoulder ring;

lowering the retrieval tool into the bore and moving the flange below the shoulder ring while the carrier member is in the extended position; then moving the carrier member and retainer member to the contracted position, causing the flange to engage the shoulder ring and pull it upward from the groove into engagement with the retainer member, which moves the shoulder ring to the contracted condition; then retrieving the retrieval tool.

* * * * *